US005890344A

United States Patent [19]

Smith et al.

[11] Patent Number: 5,890,344

[45] **Date of Patent: *Apr. 6, 1999**

[54] FLEXIBLE PRODUCT FOLDING AND TRANSFERRING APPARATUS AND PROCESS

[75] Inventors: David A. Smith, Midland; Robert J. Nestle, Essexville, both of Mich.

[73] Assignee: DowBrands L.P., Indianapolis, Ind.

[ * ] Notice: The terminal 12 months of this patent has been disclaimed.

[21] Appl. No.: 476,824

[22] Filed: Jun. 7, 1995

Related U.S. Application Data

[63] Continuation of Ser. No. 334,767, Nov. 4, 1994, Pat. No. 5,544,471, which is a continuation of Ser. No. 994,836, Dec. 22, 1992, abandoned.

[51] Int. Cl.[6] ..... B65B 35/30

[52] U.S. Cl. ..... 53/447; 53/117; 53/247; 53/429; 493/405; 493/444; 270/45

[58] Field of Search ..... 270/32, 45, 58; 493/405, 408, 419, 454, 460, 444; 271/9; 53/116, 117, 235, 247, 447, 429

[56] References Cited

U.S. PATENT DOCUMENTS

| | | |
|---|---|---|
| 1,104,663 | 7/1914 | Groom . |
| 4,238,066 | 12/1980 | Brooke . |
| 4,338,086 | 7/1982 | Heater . |
| 4,545,715 | 10/1985 | Seefeldt . |
| 4,570,411 | 2/1986 | Herrington . |
| 4,588,070 | 5/1986 | Smith . |
| 4,618,054 | 10/1986 | Muller . |
| 4,624,095 | 11/1986 | Gietman, Jr. . |
| 4,697,805 | 10/1987 | Herb . |
| 4,790,804 | 12/1988 | Gotou et al. . |
| 4,924,652 | 5/1990 | Krasuski et al. . |
| 5,014,978 | 5/1991 | Smith et al. . |

FOREIGN PATENT DOCUMENTS

| | | |
|---|---|---|
| 1325842 | 6/1973 | United Kingdom . |
| 1325842 | 8/1973 | United Kingdom . |
| 1491844 | 7/1977 | United Kingdom . |

*Primary Examiner*—W. Donald Bray

[57] ABSTRACT

An apparatus for clamping, folding and transferring a stack of flexible plastic bag products such as a stack of zippered plastic bags. The apparatus can be retrofitted in existing bag sealers used for producing and packaging a stack of plastic bags in order to produce novel shallower plastic bag products.

7 Claims, 10 Drawing Sheets

E

F

G

FLEXIBLE PRODUCT FOLDING AND TRANSFERRING APPARATUS AND PROCESS

CROSS-REFERENCE TO RELATED APPLICATION

This application is a continuation of application Ser. No. 08/334,767 filed Nov. 4, 1994, now U.S. Pat. No. 5,544,471, which was a continuation of application Ser. No. 07/994,836, filed Dec. 22, 1992, now abandoned.

BACKGROUND OF THE INVENTION

This invention relates to an apparatus and process for the manufacture of flexible film articles such as zippered plastic bags, and more particularly, this invention relates to an apparatus and process for clamping, folding and transferring a stack of zippered plastic bags to a packaging operation.

The machinery used for the production of individual flexible web products such as plastic containers and bags is well known in the art. The machinery is sometimes referred to as a "bag sealer." For example, U.S. Pat. No. 5,014,978, incorporated herein by reference, discloses the type of equipment that is used for producing individual flexible bags. Ziploc™ is a brand of zipper type flexible bags. Generally, the machinery for making these bags includes a large diameter rotating drum which contains multiple heated wire severing and sealing elements positioned in grooves located within the outer periphery of the drum for severing and sealing a continuous web of thermoplastic material which has been folded upon itself to form two plies. The individual bags, are formed by severing portions of the thermoplastic material. The severed areas become side seams for the bags and are typically sealed at the same time as they are severed by the use of the heated wire elements. The individual bags are retained on the drum by a vacuum arrangement as the drum rotates.

The individual bags formed on the large rotating drum are taken from the drum by a smaller transfer drum, also suitably equipped with vacuum. The vacuum securing the bags onto the large drum is relieved at an appropriate point, and the bags fall onto the smaller drum where they are held in position by vacuum. At an appropriate point, the vacuum is released and the individual bags are pulled off the smaller drum by an orbital packer or similar device.

The orbital packing device is provided with a set of packer fingers which move in a circular path in precise timing with the smaller drum so that the fingers remove successive bags, which are typically separated on the drum approximately a nominal ⅛ inch from each other, from the drum and stack the bags on a stacking table against a backstop.

An apparatus including a set of clamping jaws, for example as described in U.S. Pat. Nos. 4,284,301 and 4,588,070, grasp the stack of bags at the stacking table and horizontally transfers the stack of bags from the stacking table to a horizontal support platform such as supporting bars or arms. Generally, at the horizontal support platform position, the stack of bags on the support platform is in a position normally directly above a dispenser loading station. Thus, a further means for transferring vertically the stack of bags from the support platform to a packaging point is then used. For example, an actuated elevator plate having a pair of bag clamps attached to it and capable of moving vertically up and down is used to transfer the stack of bags from the platform to a dispenser loading station. Sometimes the actuated elevator plate with bag clamps is referred to as a "first fold bag clamp and elevator apparatus."

The elevator plate with the bag clamps moves up to the support platform wherein the pair of bag clamps grip the stack at the stack's approximate centerline. Then, the cam actuated elevator plate, to which said bag clamps are mounted, lowers the stack vertically through a pair of guides which places a first fold into the stack as the elevator moves down to a position just below the guides. The guides restrain the stack in a first fold position until an awaiting open turret clamp closes on the stack. Then, the bag clamps are released and the turret begins to index 180 degrees from its dwell position. As the turret indexes, the once-folded stack of bags receives a second fold as the clamped stack passes a folding guide or shroud. The shroud holds the second fold until the turret stops rotating and the turret clamps are lowered into an awaiting dispenser (via a cam actuated carton load mechanism) at a position below the turret. The final orientation in the dispenser is in the form of a twice-folded stack of bags. The twice-folding apparatus and packaging procedure is described in co-pending U.S. patent application Ser. No. 07/786,861, filed Nov. 1, 1991, by Turvey et al., incorporated herein by reference.

The above bag sealer and twice-folding apparatus works well without having to use a side shift mechanism as described in U.S. Pat. Nos. 4,284,301 and 4,588,070, when used to produce and package "normal" sized commercially available bags, for example, quart size bags, sandwich size bags, gallon size bags and other bags of a greater size which are capable of being folded twice. However, producing and packaging a stack of bags of a size smaller than the smallest commercially available bag, for example a pint size bag which has the dimensions of 5 inches from zipper to fold, on existing bag sealer equipment is not practical without modification of the existing equipment. To run a different sized bag on an existing equipment originally made to run another certain sized bag requires a major modification to the existing equipment such as described in U.S. Pat. No. 4,588,070.

In a typical bag sealer for zippered bags, for example, the heat sealing and packaging functions in the equipment are based on a fixed location for the zipper profile. If the location of the incoming zipper profile is changed, such change, would be very expensive and require days, if not weeks, of machinery downtime.

In addition, since the stacks of bags are normally folded twice about the centerline of the stack and then inserted into a cardboard dispenser, producing bags of different depths (zipper to fold) requires the use of special machine features to reposition the centerline from that in the stacking position, to that for the first fold position. U.S. Pat. No. 4,588,070 illustrates one example of the need for repositioning a stack of bags in order for the existing bag-manufacturing and packaging equipment to be able handle a different size bag.

As aforementioned, any new proposed bags of a shallow depth, for example a depth of 3.25 inches (zipper to fold), would not be practical to fold the stack twice before insertion into a dispenser. As such, a single fold, or no fold, is desirable for this type of shallower product. Therefore, due to the product size and the impracticality of a double fold, the art practiced in U.S. Pat. No. 4,588,070 can not be utilized for repositioning the shallow depth bags contemplated herein.

One approach to producing and packaging shallow bags is to replace the seal drum, clamp assemblies, transfer drum, and packaging apparatus to change an existing machine over to machinery for handling a shallower bag. However, this approach would be cost prohibitive to any proposed new bag line extension. In fact, high capital to produce the product would probably cancel the project.

Accordingly, it is very desirable to utilize existing machinery and retrofit the machinery to handle smaller sized bags than heretofore produced with minimal modifications to the existing machinery.

SUMMARY OF THE INVENTION

The present invention answers the need for an effective, inexpensive modification of existing flexible bag producing machinery by providing a unique and novel modification to standard bag sealer equipment to allow for the production and packaging of very shallow bags.

The present invention makes use of existing double-fold hardware to place a single fold into the stack of shallow zippered bags. This is made possible through novel modifications to a first fold bag clamps and elevator apparatus used in a standard bag sealer. The present invention makes use of existing equipment which was originally intended to double fold stacks of bags. This significantly reduces the capital required to produce and package the new smaller product size.

The present invention is directed to an apparatus including a base support member having an area for receiving a stack of flexible products; and a retractable means mounted to said base support member for clamping and once-folding, preferably substantially simultaneously, the flexible products on said base support member. The present invention advantageously provides a very predictable and very controllable apparatus for providing a fold to a stack of bags.

The present invention may be better understood by reference to the following detailed description taken in connection with the accompanying drawings in which like reference characters refer to like elements in the several views.

DETAILED DESCRIPTION OF THE PREFERRED EMBODIMENTS

The bag transfer apparatus of the present invention is particularly useful for handling bags of approximately ½ the depth of the bags for which a bag manufacturing and packaging machine was originally designed to handle. For example, machines exist for producing and packaging "sandwich" size bags, each of the bags having a depth of about 5⅞ inches. With the apparatus of the present invention, bags having a depth of about 3¼ inches ("snack" size bags) can be processed through the same machine used to produce the "sandwich" size bags.

Figure 1:
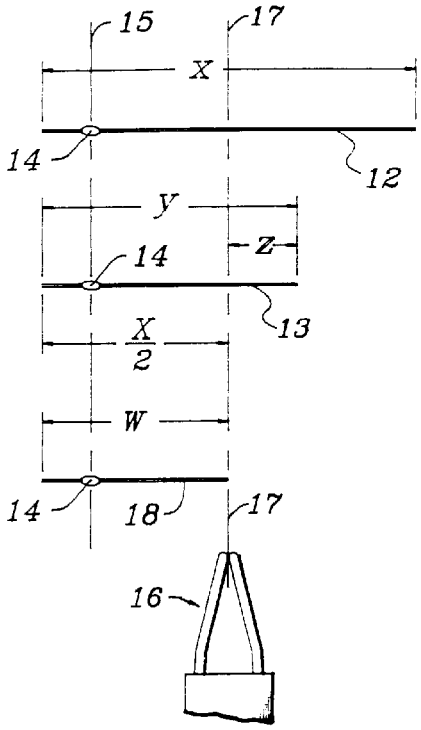
FIGS. 1 and 1A schematically show the relative sizes of bags and center line for positioning a clamping mechanism of a packaging station.

The apparatus of the present invention accommodates both the bag producing machine and packaging machine wherein a stack of bags of a small size are transferred from a station, just subsequent to forming, vertically downward to another station, just prior to packaging. The present invention takes into account the fact that the zipper profile location remains the same regardless of the bag size, in order to cooperate with a bag sealing mechanism located just before the present apparatus which mechanism uses the zippers as a reference point. A groove which tracks each bag through the sealing mechanism is machined into the seal drum which makes that location fixed. With regard to the packaging operation, an existing folding mechanism included a pair of clamp jaws with a fixed center line positioning for clamping a stack of bags substantially in the center of the stack (from top to bottom) and transferring the clamped stack of bags into a dispenser. With reference to FIG. 1, there is shown schematically the need for the present invention bag transfer apparatus for transferring shallow bags.

In FIG. 1, there is shown a large bag 12 having a depth X and a smaller bag 13 having a depth of Y which is generally about X/2+Z. Both bags 12 and 13 have a common width (not shown) and a common zipper profile location identified as 14 as indicated at center line 15. The center line positioning for the clamp jaws 16 of the packaging machine is shown in FIG. 1 by the reference number 17.

Figure 1A:
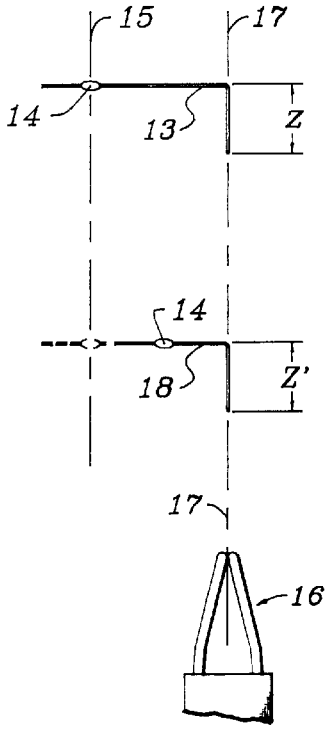

The depth Y of the smaller bag is not of sufficient depth for the clamping jaws 16 to clamp the center of a stack of bags. Normally, the stack of smaller bags can contain from 20 to 25 bags in number which also makes it difficult to fold the stack of bags at its center line. For providing a stack of bags with a double fold, the shifting mechanism described in U.S. Pat. No. 4,588,070 works well with bags having depths greater than Y but less than X, because such bags with depths between Y and X still are of a sufficient depth to provide a double fold. For bags with a depth Y that can not be double folded, the shifting mechanism described in U.S. Pat. No. 4,588,070 will not work in the present invention. Therefore, in order to maintain the center line positioning for the clamp jaws 16 of the existing folding and packaging mechanism to which the stack of bags are transferred, the portion Z of the depth Y of bag 13 must be of a sufficient length to be folded downwardly toward the center line 17, as shown in FIG. 1A, for the clamp jaws 16 to "grab" the Z portion ("tail" or bottom) of a stack of bags.

While the shifting mechanism described in U.S. Pat. No. 4,588,070 can not be used for shallow bags not capable of being folded twice, it is contemplated herein to use the present invention apparatus in combination and in conjunction with the shifting mechanism described in U.S. Pat. No. 4,588,070 for bags 18 having a depth of W which can be equal to or less than X/2, but of a sufficient depth to provide a portion Z' of sufficient length to be folded downwardly toward the center line 17, similar to that as shown in FIG. 1A, for the clamp jaws 16 to "grab" the Z' portion ("tail" or bottom) of a stack of bags. The shifting mechanism would provide a means for shifting the bags slightly over the center line positioning 17 to provide a tail for the shifted stack of bags that can be folded by the apparatus of the present invention and that the clamps jaws 16 can grab.

The apparatus of the present invention, generally referenced by numeral 20, is described more specifically with reference to FIGS. 2–10. In FIGS. 2–10, there is shown one embodiment of an apparatus 20 for clamping, folding and transferring a stack of flexible products 21 and 22, such as a stack of zippered bags. Preferably, the apparatus 20 substantially simultaneously clamps and folds a stack of bags and then subsequently transfers the stack of bags between at least two geometric planes to a packaging operation, i.e., the stack of bags is transferred, vertically down, from one station E where the stack of bags is clamped and folded to another station F where the stack of bags is received by a pair of clamp jaws 301 of a packaging mechanism (as shown in FIGS. 10A–10D).

The basic frame structure of apparatus 20, generally indicated as numeral 30 includes a horizontally positioned support platform in the form of a flat base plate member 31; side rails or cross-members 32 and 33; and block members 41, 41A, 141, and 141A which block members also form part of the clamping assemblies 40, 40A, 140, and 140A, respectively, described herein below. A means for moving the apparatus 20 vertically up and down, such as an elevator means (not shown) can be attached, for example, to the bottom surface of base plate 31. Various preferred elements of apparatus 20 are releasably attached together, for example, with nuts and bolts or threaded rods and bores, in order to provide interchangeability of the various elements and easy maintenance of the apparatus.

A first pair of clamping assembly means, generally indicated as numerals 40 and 140, respectively, is used for clamping a first stack of bags 21. A second pair of clamping assembly means, generally indicated as numerals 40A and 140A, respectively, is used for clamping a second stack of bags 22. Actuating means 101 and 201 are used for opening and closing the clamping assembly means 40, 40A, 140 and 140A, respectively.

A top plate 36 is adapted for receiving the stack of bags 21 and 22. The top plate 36 has folding ledges 37. The top plate 36 is attached to the four blocks 41, 41A, 141, and 141A (described herein below) in a substantially parallel plane above the bottom plate 31. The top plate 36 provides a surface for laying the stack of bags 21 and 22 substantially flat on top of the plate 36 with a bottom portion of the bags overhanging the ledges 37. The bottom portion of the bags corresponds essentially to length "Z" or "Z" in FIG. 1 and is of sufficient length for a pair of jaws to clamp the portion "Z" or "Z'". The weight of the bottom portion of the bags, which overhangs the ledge 37, is not sufficient for gravity alone to act on the bottom portion to create a fold in the stack naturally. The bottom portion must be forced downwardly, by an external means, to create the fold in the stack of bags. Preferably, the ledges 37 in conjunction with a fold-inducing finger portion 68, 68A and 168 and 168A described herein, provide a means for folding the stack of bags 21 and 22 by contacting the top of the stack of bags with the fold-inducing finger portion which, in turn, biasing the bottom portion of the bags against the ledge to create a fold in the stack of bags.

As described and illustrated herein, the present invention is directed to an apparatus 20 which is particularly useful for retrofitting into present commercial equipment, that is, bag sealer apparatuses which are designed to produce side-by-side pairs of stacks of bags simultaneously and package those bags with separate pieces of packaging equipment. Accordingly, as described herein, the present invention is designed to handle a pair of stacks of bags 21 and 22, utilizing a first pair of clamping assemblies designated as clamping assemblies 40 and 140; and a second pair of clamping assemblies designated as clamping assemblies 40A and 140A (for a total of four individual clamping assemblies 40, 40A, 140, and 140A), i.e., a pair of clamping assemblies for each stack of bags 21 and 22. However, it is understood that the scope of the present invention is not limited to any one embodiment described herein, but covers embodiments wherein only one stack of bags, for example bags 21, is being processed and only one pair of clamping assemblies, for example clamping assemblies 40 and 140A, is being utilized to handle a single stack of bags. Such minor modifications and variations in designs to the present invention are well within the capabilities of those skilled in the art and are intended to be covered by the scope of the present invention.

Figure 2:
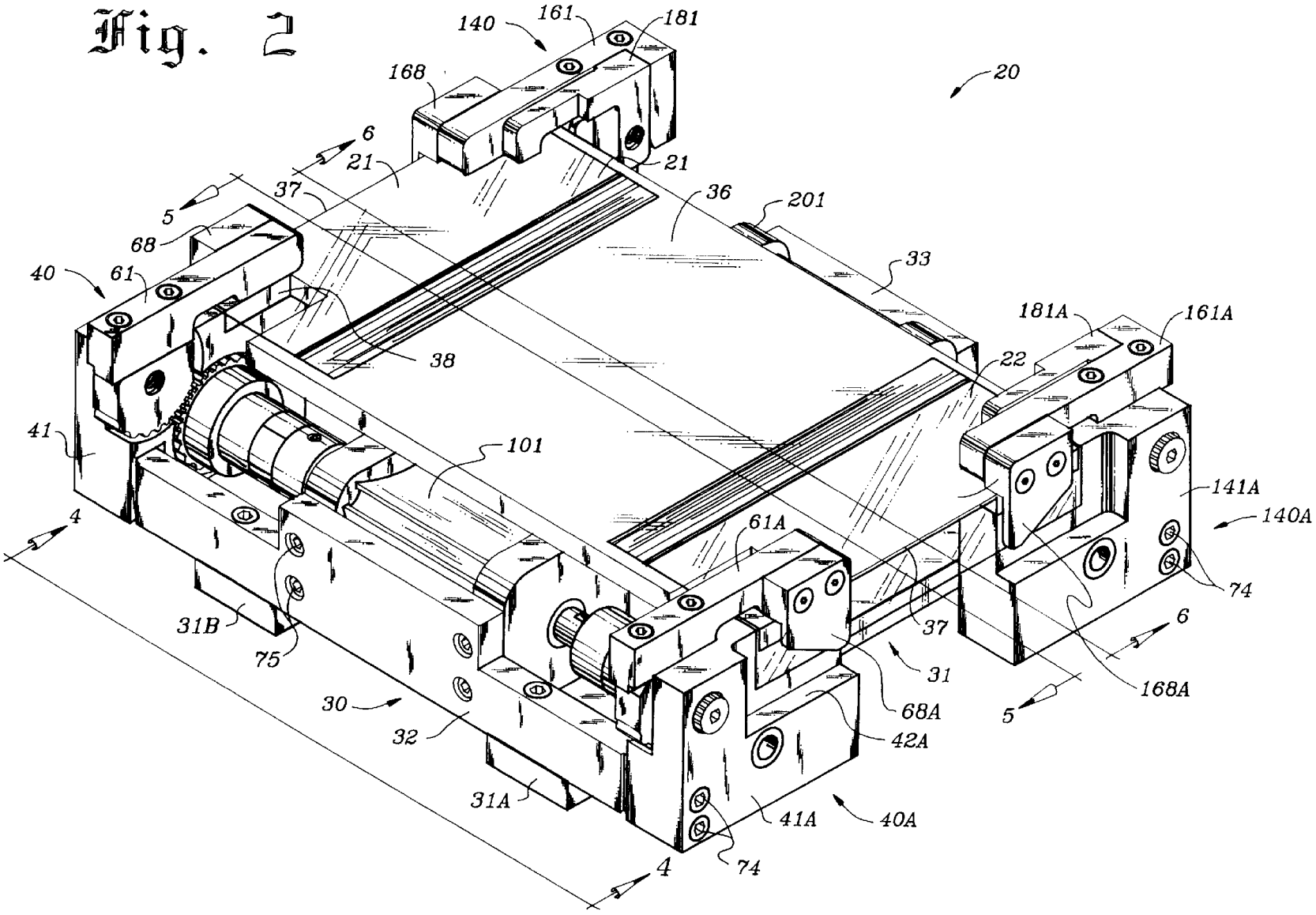
FIG. 2 shows a perspective view of an apparatus of the present invention with bags in a clamped position.
Figure 3:
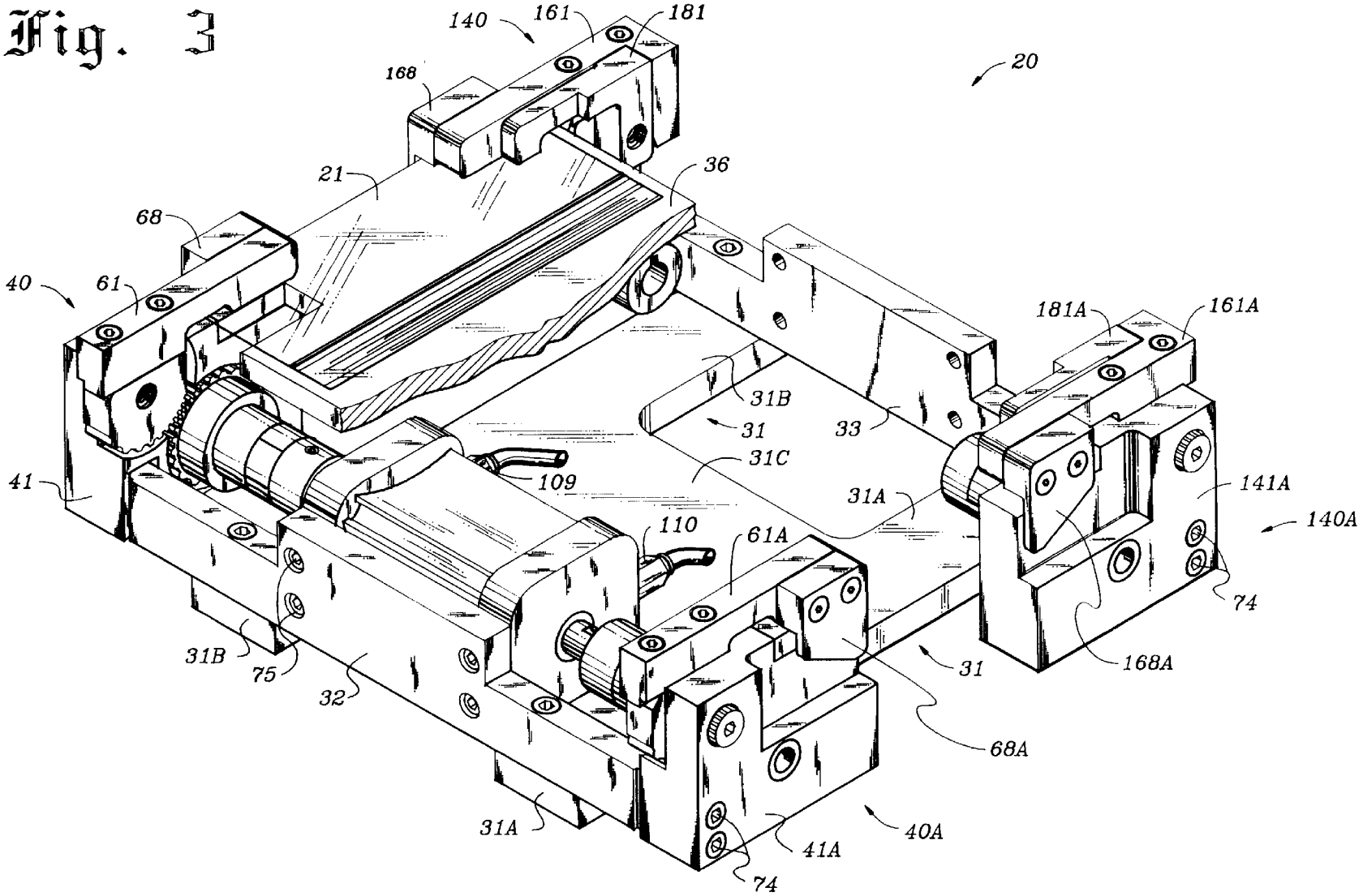
FIG. 3 shows a perspective view, partly in section, of an apparatus of the present invention with portions of the apparatus removed.
Figure 4:
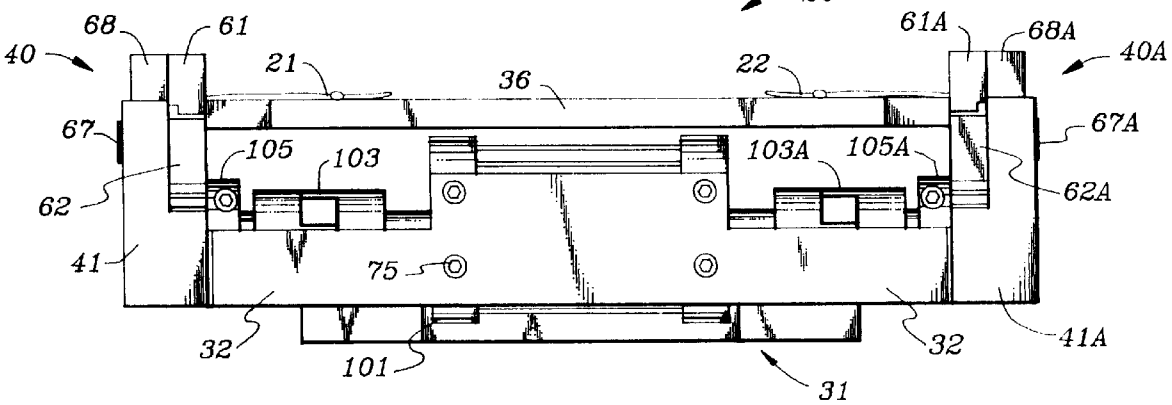
FIG. 4 shows a front view of the apparatus of the present invention taken along line 4—4 in FIG. 2.

With reference to FIGS. 2 and 3, the base plate 31, in this instance, is generally "H-shaped" having parallel plate portions 31A and 31B with a transverse plate portion 31C attached normal to portions 31A and 31B and generally at the mid-section of portions 31A and 31B. The H-shaped plate 31 is conducive for accommodating actuators 101 and 201 and for attaching clamping assemblies 40, 40A, 140 and 140A thereto. While the base plate 31, in this instance, is shown to be H-shaped, it is understood that various other shapes and modifications are possible, for example, a flat plate containing recesses, and such variations are intended to be covered by the scope of the present invention.

The first pair of clamping assemblies for clamping a first stack of bags 21 includes a first clamping assembly 40 and a second clamping assembly 140. The first clamping assembly 40, shown in FIGS. 2–6, includes a block member 41 configured with various recesses, indentations, bores and flat surfaces adapted for releasably mounting a clamping means, a folding means and an actuating means to the block member 41 for clamping and folding a stack of bags 21.

Figure 7:
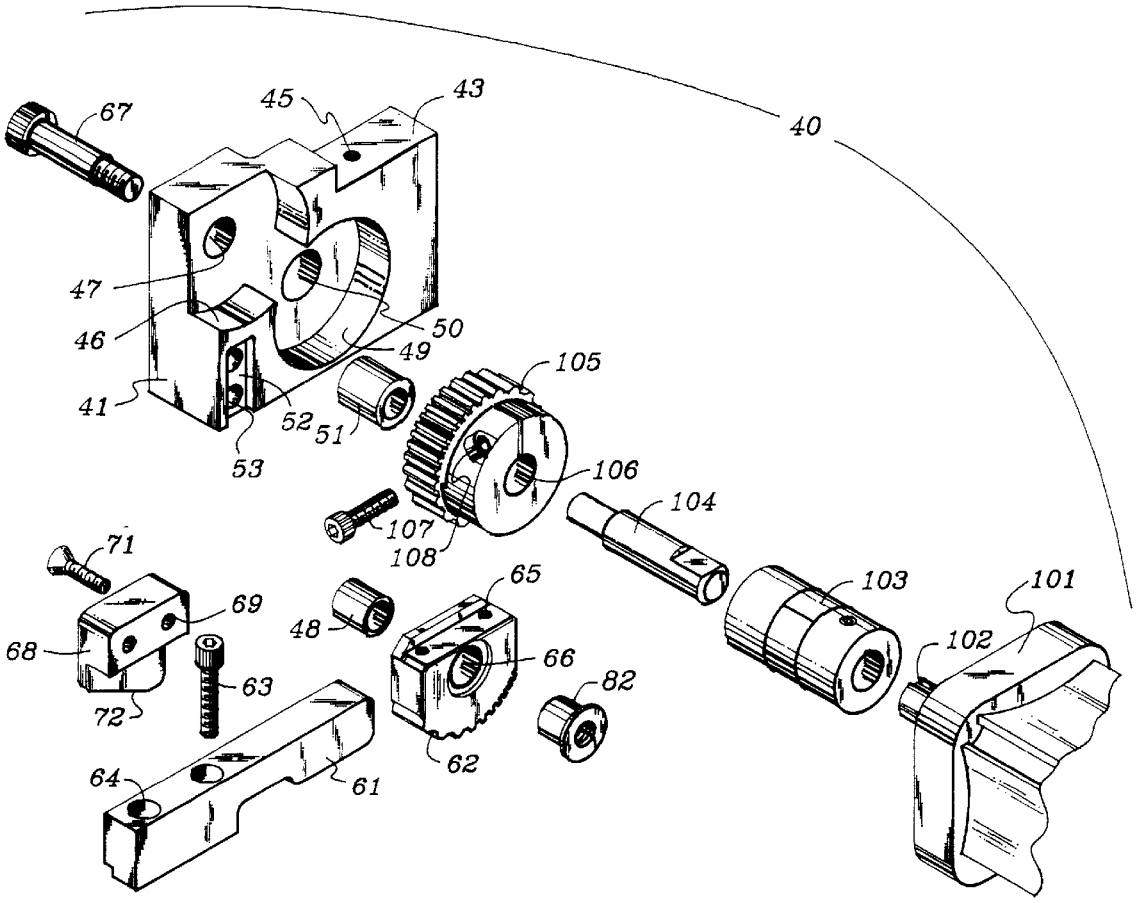
FIG. 7 shows an exploded view of a portion of the apparatus of the present invention.

One embodiment of the block member 41 shown in FIG. 7, but not limited thereto, contains a recess (and ledge) 42 (see FIGS. 9A and 9C) for accommodating a fold-inducing finger portion 68; a recessed top flat surface 43 for receiving and attaching top plate 36 thereto, for example by a threaded bolt (not shown) and threaded hole 45; a recess 46 for accommodating clamp finger gear 62; a bore 47 with a bearing 48 press fitted therein adjacent recess 46 for passing a shoulder bolt 67 therethrough for mounting the clamp finger gear 62; a recess 49 for accommodating a drive gear 105; and a bore 50 with a bearing 51 press fitted therein for passing a shaft member 104 therethrough attached to an actuator 101. The recesses 46 and 49 are adjacent and integral, sufficient to provide contact and engagement of the drive gear 105 with the clamp finger gear 62. The block member 41 also includes a recess 52 for accommodating one end of the cross member 32 and the recess 52 further contains a couple of pass through holes 53 for releasably attaching the cross-member 32 having threaded bores (not shown) to the block member 41 with threaded screws or bolts 74.

Releasably and pivotally mounted to the block member 41 is a first clamp finger 61. The clamp finger 61 is preferably mounted to block 41 by first attaching the finger 61 to clamp finger gear 62, for example with threaded bolts 63 passed through bores 64 and into threaded holes 65 on the clamp finger gear 62. The clamp finger gear 62 contains a non-threaded bore 66 having a flange bearing 82 press fitted into the bore. The inside channel of the flange bearing 82 is threaded for receiving a partly threaded shoulder bolt 67 which passes through bore 47 of the block member 41 and threads into bearing 82 in the gear 62 to mount the first clamp finger 61 to block 41. Attached to finger 61 is a fold-inducing finger portion 68 via bores 69 in the finger portion 68 and tap holes (not shown) in clamp finger 61 and threaded bolts 71. The fold-inducing finger portion 68 contains a tapered edge 72 to minimize the fold-inducing finger portion 68 from interfering with or disturbing the arrangement of the stack of bags 21 when the fold-inducing finger portion 68 comes into contact with the stack of bags 21. The preferred tapered edge 72 and the finger portion 68 will contact the stack of bags 21 after the stack is firmly clamped by pre-clamping finger 181. The pre-clamping finger 181 essentially keeps the stack of bags 21 from moving when the tapered edge 72 contacts the stack.

As aforementioned, releasably mounted to block member 41 at recess 52 is cross member 32 via threaded bolts 74 passed through bore 53 and threaded holes (not shown) at one end of cross member 32. The other end of cross member 32 is releasably attached to back member 41A. The actuator 101 is attached to near the center of the cross member 32 by threaded bolts 75. The actuator 101 contains shaft member 102, a coupling 103, a shaft member 104, and a drive gear 105 with a bore 106 for receiving the shaft member 104. The drive gear 105 also contains a threaded hole 108 and a threaded bolt 107 for attaching the gear 105 to shaft 104 such that the gear 105 can be rotated by the rotary actuator 101. The actuator 101 is activated, in this instance, with air from an air source (not shown) via air supply inlet and outlet nozzles 109 and 110, respectively (see FIGS. 3 and 5).

The drive gear 105 is releasably and rotatably mounted to block 41 using the shaft member 104 passing through bore 106 of the gear 105 and bearing 51 in bore 50 of the block 41. The drive gear 105 is releasably secured to shaft 104 by threaded bolt 107 passed through threaded hole 108 in gear 105 to engage the shaft 104 in a locking position. The shaft piece 104 is coupled to the actuator shaft 102 by coupling 103.

Figure 8:
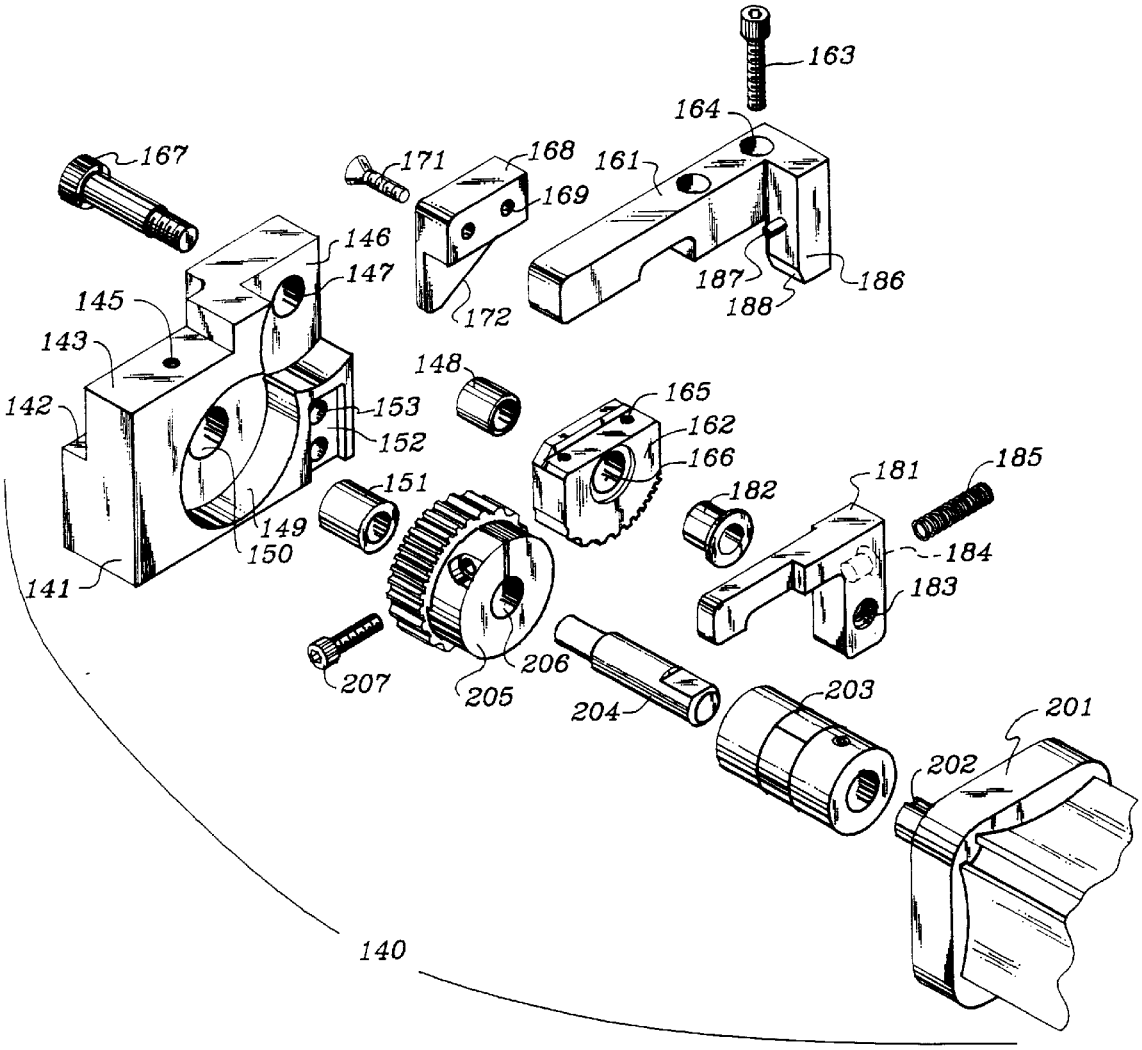
FIG. 8 shows an exploded view of a portion of the apparatus of the present invention.

With reference to FIG. 8, there is shown the second clamping assembly 140 which is substantially identical to the first clamping assembly 40, in mirror image, except that preferably the assembly 140 contains a pre-clamp finger 181 and a modified first clamp finger 161 to function in cooperation with the pre-clamp finger 181. In this instance, the pre-clamp finger 181 is mounted to block 141 by providing a flange bearing 182 press fitted into a non-threaded bore 166 of gear 162. The pre-clamp finger 181 contains a threaded bore 183 for receiving the partly threaded shoulder bolt 167 which passes through 148 in bore 147 and bearing 182 in base 166 and then thread into bore 183. The pre-clamp finger 181 also contains a countersunk hole 184 for receiving a spring 185. A stop portion 186 normal to the bottom end of the finger 161 forming an "L-shaped" finger member 161 is used to support pre-clamp finger 181. A dowel pin member 187 supports the spring member 185 to the stop portion 186. The spring 185 provides flexibility and resiliency to the pressure of the pre-clamp finger 181 to the stack of bags 21 as the spring compresses. The pre-clamp finger 181 is preferably tilted in a slightly forward position to engage the stack of bags 21 before the first clamp finger 161 engages the stack of bags 21. Tilting is provided by an optional beveled edge 188 in stop portion 186.

In the preferred embodiment of the present invention, only the second clamping assemblies 140 or 140A contain a pre-clamp finger 181 or 181A, respectively (see FIGS. 2 and 3), although it is contemplated that the first clamping assemblies 40 and 140 could also include a pre-clamp finger if desired. A pre-clamp finger is not required in assemblies 40 and 140 as shown in the preferred embodiment described herein above, because conventional horizontal transfer clamps (not shown) which transfer the stack of bags onto the top of plate 36 provide the necessary function of securing the stack of bags on top plate 36 on that side of the plate 36 prior to folding the stack. The horizontal transfer clamp, in this instance, is not released until the bags are folded. Recesses 38 in plate 36 are adapted for accommodating the horizontal transfer clamp. An example of a horizontal transfer clamp useful in the present invention is described in U.S. Pat. No. 4,588,070, incorporated by reference.

While a pre-clamp finger is preferred in the second clamping assemblies 140 or 140A, it is within the scope of the present invention to have clamping assemblies without the pre-clamp finger. The pre-clamp finger advantageously secures the stack of bags prior to folding to ensure that the individual bags in the stack are not disturbed or misaligned as the clamping fingers 61, 161, 61A and 161A are moved into clamping and folding engagement with the stack.

A mirror image of the first pair of clamping assemblies 40 and 140, is a second pair of clamping assemblies 40A and 140A, respectively, releasably attached to apparatus 20 for clamping a second stack of bags 22. The second pair of clamping assemblies are shown in FIGS. 2 and 3. The elements of assemblies 40A and 140A are identical to those of assemblies 40 and 140, respectively, except in mirror image and, thus the description of assemblies 40A and 140A can be referenced to assembly 40 and 140, respectively.

Figure 5:
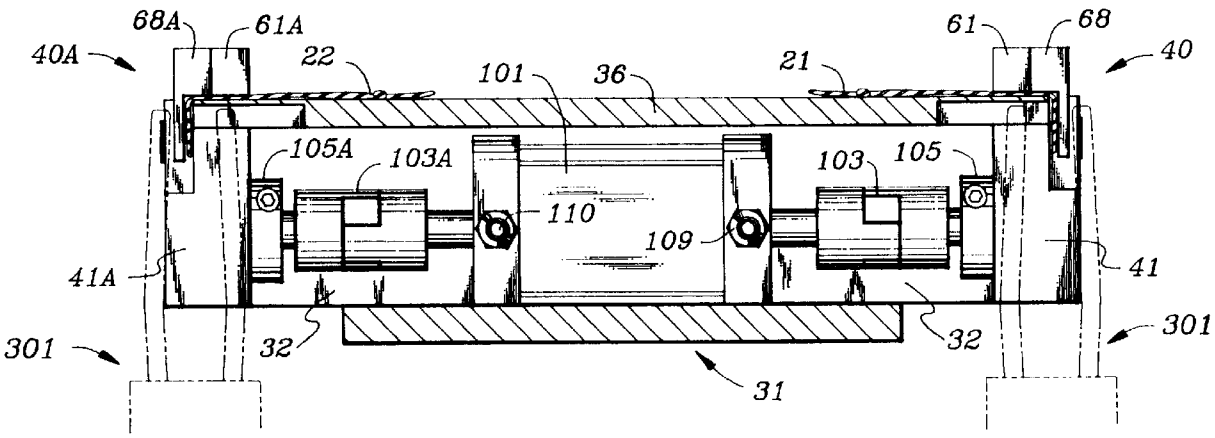
FIG. 5 shows a partly sectional view of the apparatus of the present invention taken along line 5—5 in FIG. 2.
Figure 6:
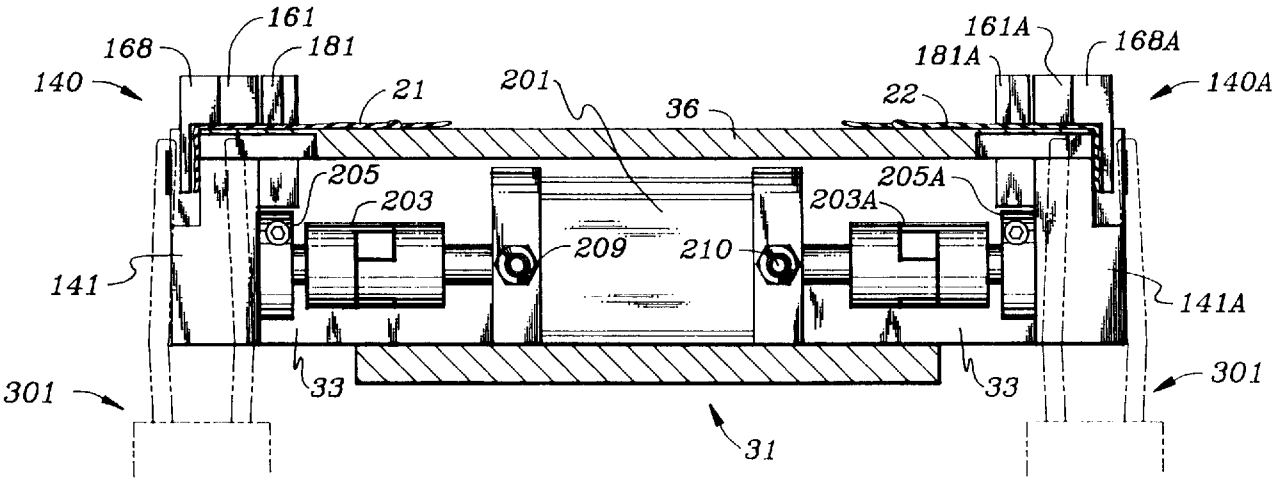
FIG. 6 shows a partly sectional view of the apparatus of the present invention taken along line 6—6 in FIG. 1.

In FIGS. 5 and 6, there is shown actuators 101 and 201 which are releasably attached to block 41A and 141A as described before with respect to block 41 and 141. The actuators 101 and 201 are preferably pneumatic rotary actuators, although hydraulic piston-type devices, electrical devices or other known actuators can be used. The actuators, in this instance, are actuated with air from an air source (not shown) via air supply and air return nozzles 109 and 110, respectively and 209 and 210, respectively.

Figure 9A:
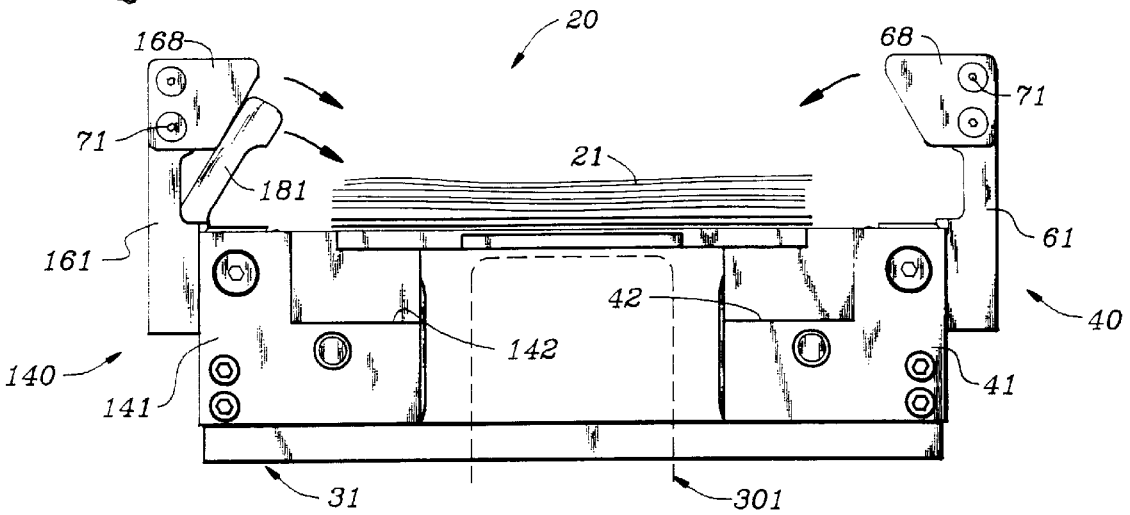
FIGS. 9A, 9B, and 9C shows a sequential view of the clamping and folding process of a stack of bags utilizing the apparatus of FIG. 2.
Figure 9B:
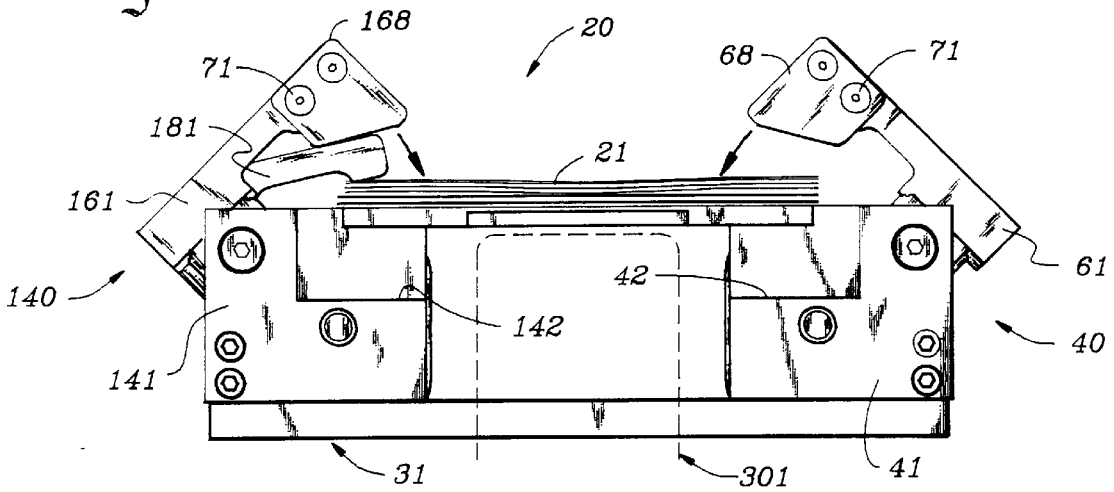
Figure 9C:
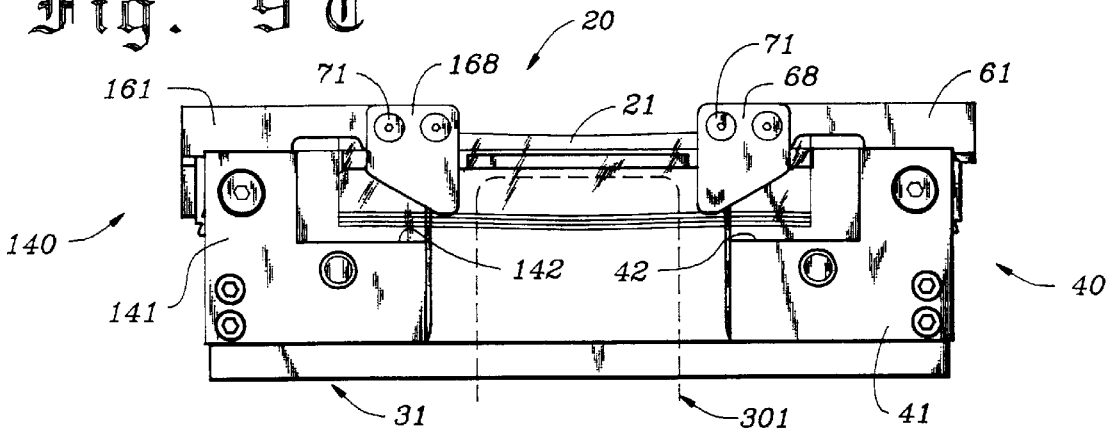

Shown in the series of FIGS. 9A–9C is the clamping and folding action of the apparatus 20 of the present invention. FIG. 9A shows the clamping fingers 61 and 161 and the pre-clamp finger 181 prior to activating the actuators 101 and 201 in an "open position." When the actuators 101 and 201 are preferably substantially simultaneously activated in one direction, the shafts 102 and 202 rotate a sufficient amount to cause the clamp fingers 61 and 161 to pivot inwardly. As shown in FIG. 9B, the pre-clamp finger 181 first engages the stack of bags 21 on one side of the stack coming to rest in a "closed position" against the stack of bags 21 before the clamp fingers 61 and 161. Then, as shown in FIG. 9C, as the actuators continue to rotate, the clamping fingers 68 and 168 engage the stack of bags causing the fold-inducing portion 68 and 168 to form a fold in the stack. Upon activating the actuators 101 and 201, in the opposite direction, the shafts 102 and 202 rotate sufficiently a predetermined amount of degrees (i.e., restrictively or partly) to, in turn, cause the clamping fingers 61 and 161 to pivot outwardly coming to rest in their original "open position" with respect to the clamping table or top plate 36 and ready to receive another stack of bags.

While the above preferred embodiment shown in FIGS. 2–10 employs two actuators, 101 and 102, in another embodiment of the present invention, a single actuator, as described in U.S. application Ser. No. 786,861, incorporated herein by reference, can be used to provide for substantially simultaneously actuating all for clamping fingers. The embodiment using a single actuator advantageously eliminates the need to provide a separate actuator to each clamping finger as usually done in the prior art. The single actuator embodiment provides less moving parts and ensures simultaneous, as well as equal force, application to flexible products.

In operation, the entire apparatus 20 is attached to an elevator means (not shown) which moves the apparatus 20 vertically up and down. Starting in a down position the apparatus 20 is moved up to a predetermined height and position (see position E in FIGS. 10A–10D) for receiving a stack of flexible products such as a stack of plastic bags 21 and 22. After the stack of bags 21 and 22 are positioned on top of the top plate 36 with the clamping finger members in an open position, the clamping finger members are then closed to clamp the bags against the top surface of the top plate 36 which provides a single, about 90 degree-fold to the stack of bags. Once the stack is clamped and folded, the apparatus 20 having the clamped and folded stack of bags 21 and 22 is then transferred down to a second position (see position F in FIGS. 10A–10D) for further handling and packaging.

As shown in the series of FIGS. 10A to 10D and FIG. 11, the apparatus 20 with the clamped and folded stack of bags 21 travels vertically down to a turret clamping assembly 300. The stack of bags are clamped at the base of the fold by a turret clamp 301 or 302 of the turret assembly 300. As the turret assembly 300 rotates (as indicated by directional arrow 303 in FIG. 11) the stack of bags 21 contact guide or shroud 304 to maintain the fold in the stack of bags as the stack of bags leave the end of the shroud 304. As the turret assembly arms 305 and 306 contact a cam member 307 and 308, respectively, the clamping member 301 releases the folded bags at point G to load the folded bags 21 into a dispenser 400. The turret clamps 301 or 302 rotate 360 degrees to the point where the clamps 301 or 302 receives another set of bags transferred from the apparatus 20 ending one complete cycle for the turret assembly clamps 301 or 302. The dispenser 400 is then transferred to sealing equipment and to further packaging equipment conventionally known.

Figure 10A:
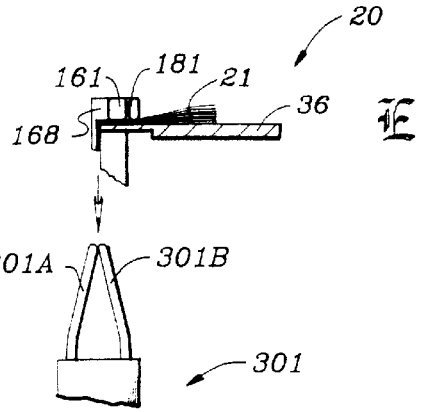
FIGS. 10A–10D shows a schematic view of the sequence of transferring a folded stack of bags from the apparatus of FIG. 2, which is partly shown, to another clamping device of a packaging apparatus.
Figure 10B:
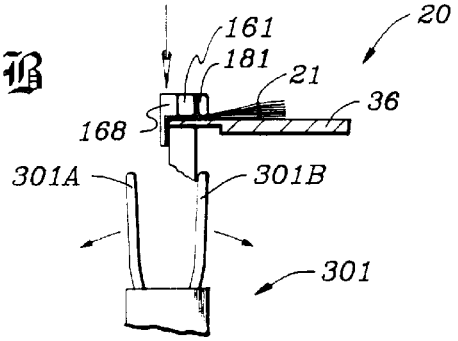
Figure 10C:
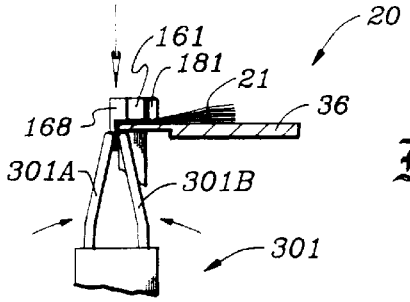
Figure 10D:
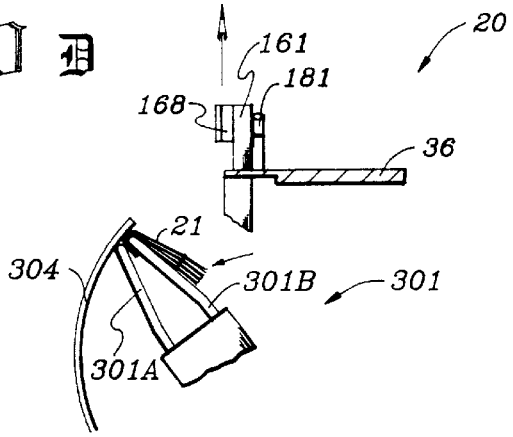
Figure 11:
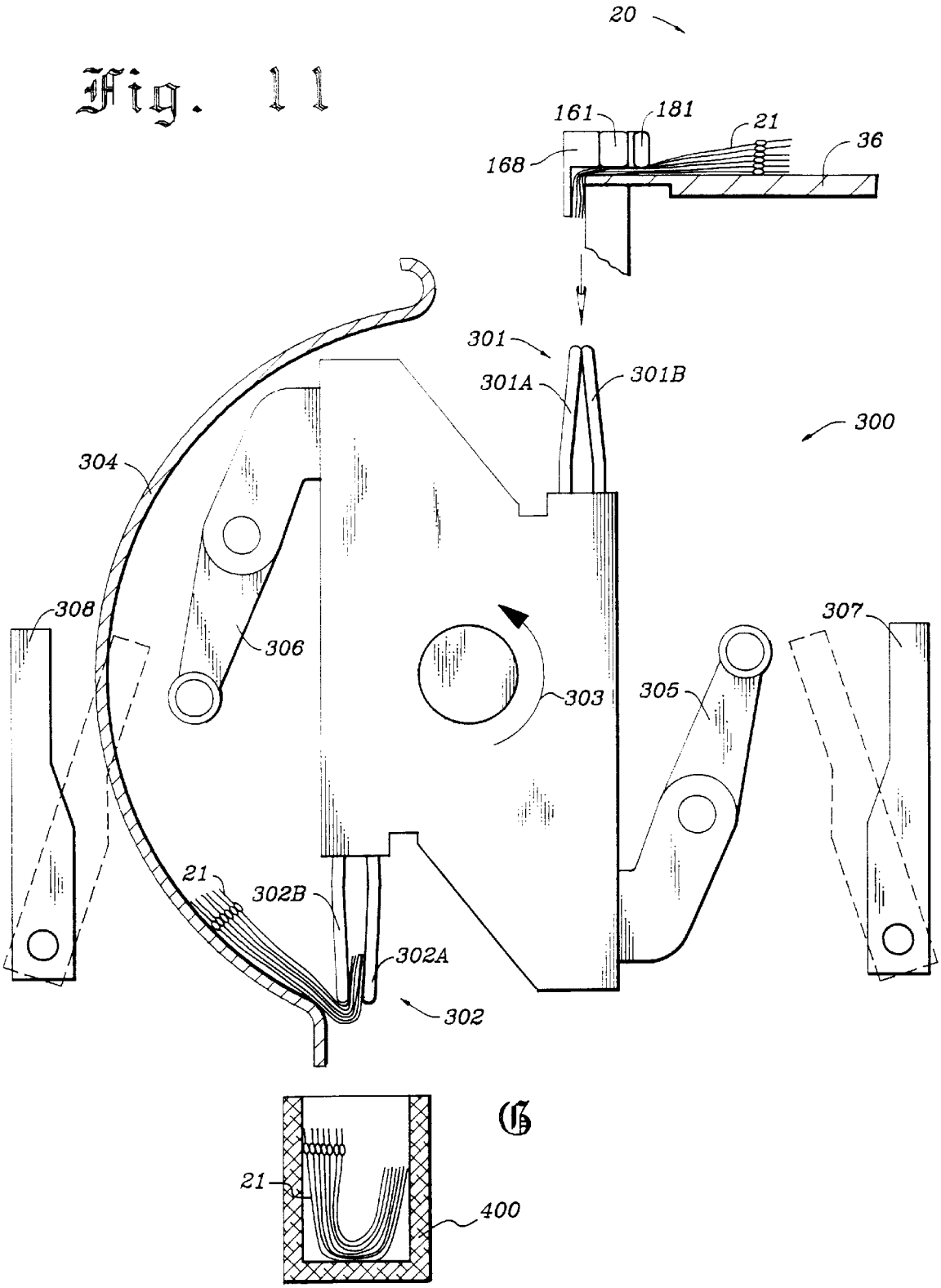
FIG. 11 is a schematic of packaging equipment for a stack of bags which have been transferred thereto by the apparatus of the present invention (partly shown).

Again as shown in FIGS. 10A–10D and FIG. 11, in carrying out the present process of the present invention, a bag clamp apparatus 20 of the present invention substantially simultaneously clamps and folds the bottom edges of a bag stack 21 on a support platform 36 (See FIG. 10A). The fold is ideally about 90 degrees. The apparatus 20 with support platform and stack of bags is lowered vertically (with an elevator, not shown which is preferably cam actuated) to a position, without creating any further folds, to an awaiting clamp 301 (see FIG. 10B). The small folded edge of the stack, desirably about ½ inch or more in length, is placed directly into the awaiting, open turret clamp 301 and the turret clamp fingers 301A and 301B close onto the bag bottoms (see FIG. 10C). The clamp fingers of the apparatus of the present invention 20 release and the turret clamp 301 rotates in a conventional manner as shown in FIG. 10D. No second fold is placed into the stack of bags and the turret simply maintains the first fold. The shroud 304 restrains the stack of bags, and the dispenser 400 is loaded in a conventional manner (see FIG. 11).

The final orientation of the product in the dispenser is preferably a once-folded stack at position G. The geometrical shape of the dispenser 400 constrains the stack of bags in a once-folded position. In another embodiment, the dispenser can be shaped to accept a stack of bags which are stacked in a generally planar or flat orientation. By modifying the dispenser geometry, the stack of bags can be accommodated without a fold or in a flat position. The apparatus 20 of the present invention and the turret assembly 300 would operate in the same way as described above except that at position G, the dispenser 400 would be shaped, for example, rectangularly and of sufficient depth and width to accommodate the stack of bags without allowing the stack to contact the walls of the dispenser to maintain a fold. Instead, each of the bags in the stack would be allowed to lay down horizontally without a fold in the dispenser.

The present invention has been described above with reference to specific embodiments and details for purposes of illustrating the invention only. It will be apparent to those skilled in the art that various changes in the methods and apparatus disclosed herein may be made without departing from the scope of the present invention, which is defined in the appended claims. For example, it is contemplated that a separate actuator could be used to operate a member to pin the stack of bags and a separate actuator to operate a knife member to fold the stack of bags actuated from above and at a plane perpendicular to the stack of bags instead of the clamp fingers. In another contemplated embodiment, a one-piece folding knife member having an adjustable or retractable clamping member, such as a spring loaded clamp, mounted to the knife member could be used wherein the clamp contacts the stack of bags substantially simultaneously or prior to the knife member contacting the bags. Also, a single clamp extending horizontally across the entire width of the bag and transfer apparatus could be used instead of a pair of clamping fingers.

What is claimed is:

1. An apparatus comprising:

a base support member having an area for receiving a stack of flexible products; and a retractable means mounted to said base support member, said retractable means having means for clamping and once-folding the stack of flexible products between the retractable means and said base support member.

2. The apparatus of claim 1 wherein retractable means is releasably mounted to said base support member.

3. The apparatus of claim 1 wherein the retractable means for clamping and folding is one member which substantially simultaneously clamps and folds the stack of flexible products.

4. The apparatus of claim 1 wherein the retractable means comprises at least two separate members including (a) a means for clamping the stack of flexible products and (b) a means for folding the stack of flexible products.

5. The apparatus of claim 1 wherein the base support member is a flat plate member.

6. A process of transferring a stack of flexible products from one location to another comprising:

(a) moving a stack of flexible products in the same geometric plane to align the stack in a position to fold at least a portion of the stack;

(b) clamping the stack of flexible products between a retractable means and a base support member; and (c) folding once at least a portion of the stack between the retractable means and the base support member.

7. The process of claim 6 including the step of moving the stack vertically from one geometric plane to another.

* * * * *